US008322109B2

(12) United States Patent
Trangsrud

(10) Patent No.: US 8,322,109 B2
(45) Date of Patent: Dec. 4, 2012

(54) MULTI-CAGE SPACER

(75) Inventor: Julian P. Trangsrud, Northfield, MN (US)

(73) Assignee: Royal Environmental Systems, Inc., Stacy, MN (US)

( * ) Notice: Subject to any disclaimer, the term of this patent is extended or adjusted under 35 U.S.C. 154(b) by 332 days.

(21) Appl. No.: 12/474,849

(22) Filed: May 29, 2009

(65) Prior Publication Data

US 2010/0300033 A1 Dec. 2, 2010

(51) Int. Cl.
*E04C 5/16* (2006.01)

(52) U.S. Cl. ..... 52/686; 52/685; 52/687

(58) Field of Classification Search ..... 52/685–687, 52/677, 680, 688
See application file for complete search history.

(56) References Cited

U.S. PATENT DOCUMENTS

| | | | | |
|---|---|---|---|---|
| 3,895,470 | A * | 7/1975 | Wurth | 52/686 |
| 4,489,528 | A | 12/1984 | Tolliver | |
| 4,854,106 | A * | 8/1989 | Bogar | 52/719 |
| 4,989,388 | A | 2/1991 | Schmidgall et al. | |
| 4,999,965 | A | 3/1991 | Schmidgall et al. | |
| 5,487,251 | A | 1/1996 | Tolliver et al. | |
| 6,758,021 | B1 | 7/2004 | Trangsrud | |
| 6,899,310 | B1 | 5/2005 | Trangsrud | |
| 6,910,309 | B2 * | 6/2005 | Trangsrud | 52/685 |
| 7,328,538 | B2 | 2/2008 | Trangsrud | |
| 2009/0049789 | A1 | 2/2009 | Ferro De La Cruz | |

* cited by examiner

*Primary Examiner* — William Gilbert
(74) *Attorney, Agent, or Firm* — C. G. Mersereau; Nikolai & Mersereau, P.A.

(57) ABSTRACT

A spacer for positioning and locking spaced reinforcing cages into a combined integral unit for reinforcing large concrete structures is disclosed that is readily snapped into place even with narrow lattice cages.

47 Claims, 5 Drawing Sheets

MULTI-CAGE SPACER

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to spacer devices used in conjunction with reinforcement structures for large concrete articles such as pipes, boxes and building structures. More particularly, the concept as related to spacers for use in maintaining concentric or parallel reinforcing assemblies in spaced relation relative to each other and to a form or mold in the fabrication of concrete structures.

II. Related Art

The manufacture of reinforced concrete structures often involves the use of a pair of steel mesh fabric shapes disposed in spaced parallel relation within the structure and spaced from the surfaces of the structure. In boxes, tanks, pipes or other enclosed structures, may resemble concentric mesh fabric cages and may be round, square, rectangular or other enclosing shape or even as sections of flat mesh for use in concrete walls. These reinforcing structures are typically welded wire or reinforcing rod (rebar) mesh fabric assemblies that may be characterized by a relatively dense lattice-weaving pattern which leaves relatively small openings through which the assemblies must be tied together in fixed relation by spacer elements to maintain the desired fixed space orientation both between the mesh structures and between the mesh structures and any molds for the casting or other pour operation. During the manufacturing process, particularly with precast shapes, various forces may be exerted on the double reinforcing mesh structures such as cage structures that may tend to separate the fabrics or tend to move them closer together. Twisting forces may also occur so that the spacers must be adequately secured to both fabrics, cages, etc. Pouring steps may be particularly stressful to the framework.

It is known to provide formed bent wire spacer elements to space a pair of wire reinforcing fabrics and to engage a form at one edge. These devices have been assembled and secured in place using wire ties or by being welded in place. More recently, spacer devices have been developed which can be manipulated into place without the use of ties or welds. Such devices are disclosed in Tolliver (U.S. Pat. No. 4,489,528) and Schmidgall et al (U.S. Pat. No. 4,999,965), for example. While these devices do space fabrics from each other and from mold walls, they require sections of wire or rods to be formed in intricate patterns that must be manipulated into place to attach to the mesh fabrics and that remains quite a labor-intensive assembly operation, even though welding or ties may not be necessary.

Thus, there remains a need for a spacer device for spacing, positioning and securing of spaced pairs of metal or other reinforcing fabric shapes in concrete structures that enables a less labor-intensive assembly and which enables the spacer devices themselves to be more easily fabricated from a variety of materials.

SUMMARY OF THE INVENTION

The present invention provides versatile spacer device designs for use wherever a plurality of reinforcing fabric shapes are employed in a concrete form. The spacers are easily installed even though very dense mesh weaves may be used and the devices lock into place with a minimum of manipulation. The spacers include a pair of spaced locking portions including first and second locking portions, each having a recess for receiving a fabric element and a trapping and retaining component for capturing and retaining a received fabric element. A generally straight central portion connects the pair of spaced locking portions and access to the pair of spaced locking portions is designed for positive attachment and ease of assembly.

The spacer is configured so that the first locking portion has an entrance directed generally such that the spacer can be inserted through an opening in the mesh of a first or near fabric and snapped onto an element of a second spaced fabric either by directly snapping onto the element or by hooking over the element and being retracted to lock the first portion onto the element of the second fabric. At this point, the second locking portion is configured such that it can be simply snapped directly onto a corresponding element of the first fabric. Thus, the first locking portion can have an entry directed away from the central portion or back toward the second locking portion but, in either case, assembly involves only a push-pull or linear motion and a finger grip may be provided on one end of the spacer element making assembly even easier.

A mold spacer extension can be provided on one or both ends of the spacer element depending on the particular application of the element. The distance between the locking portions and the size of the locking portions themselves can be varied such that spacers of different sizes can easily be fabricated. Spacers are preferably molded from relatively high-strength plastic materials, but metal components are also contemplated.

The spacer locking portions themselves include one integral inward directed capture member or a converging pair of opposed capture members extending generally at an angle from the entrance to the locking portion such that the capture member or members may be deflected resiliently by an object such as a rebar entering the locking portion so that the rebar or other element is captured and locked in place once beyond the inward directed member or members. Preferably, the locking portion includes a pair of opposed inward directed capture members for capturing and locking mesh elements such as a rebar section.

It will also be appreciated that the spacer of the present invention can be made as strong as desired by molding in a reinforcing rib or even using a metal core to increase the strength of the device. It will also be appreciated that the molded plastic spacers of the present invention will not corrode and deteriorate over time and will maintain their integrity.

The inventive concept also includes a composite double mesh fabric concrete reinforcing structure made using the spacers of the present invention and a method of assembling a concrete reinforcement structure utilizing the spacers of the present invention.

BRIEF DESCRIPTION OF THE DRAWINGS

In the drawings wherein like numerals depict like parts throughout the same.

DETAILED DESCRIPTION

The following detailed description pertains to several embodiments of the inventive concept, each of which is presented by way of example rather than with any intent to limit the scope of the inventive concepts. It will be recognized that additional variations may occur to those skilled in the art which also would come within the scope of the inventive concept.

Figure 1A:
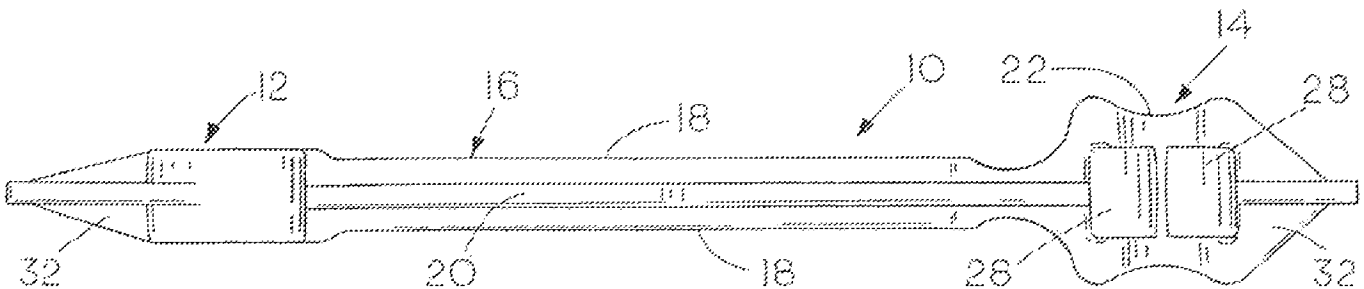
FIG. 1A is a top view of one embodiment of the spacer of the invention which includes mold spacers at both ends and may be used, for example, in a box pyramid locking device.
Figure 1B:
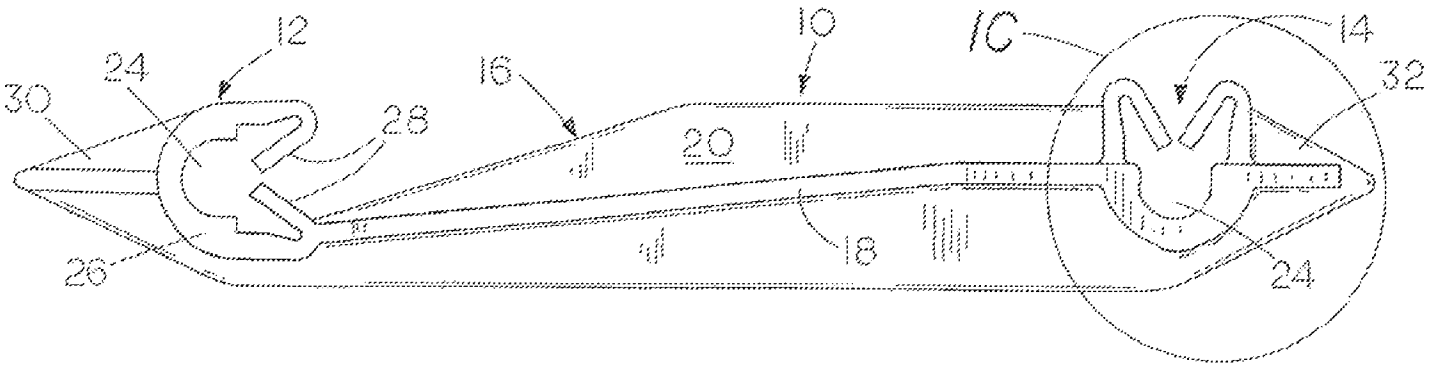
FIG. 1B is a side view of the spacing device of FIG. 1*a;*
Figure 1C:
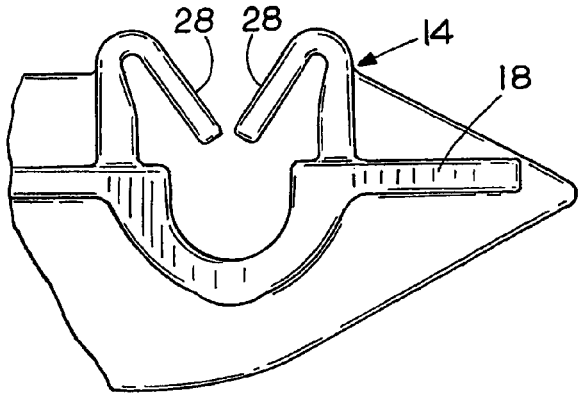
FIG. 1C is an enlarged fragmentary detail circled at (C) in FIG. 1B.

FIGS. 1A-1C illustrate a typical spacer element in accordance with the invention. The spacer element is depicted generally at 10 and includes first and second locking portions 12 and 14 spaced by a generally straight central portion 16. The structure includes a reinforcing rib 18 which runs the length of the structure 10 and is generally perpendicular to a central connecting fin 20. A finger grip is provided at the vicinity of the second locking portion as shown at 22. Each of the locking portions 12 and 14 includes a reinforcing fabric element receiving portion which might be a rebar engaging portion 24 with supporting segments and a pair of opposed integral inward directed capture members or retaining arms 28. The inward directed capture members 28 are sufficiently resilient such that a heavy wire or rebar rod element, once encountered, can force them apart and enter the locking portion and come to rest in the engaging portion 24 in the manner of the spacer device being snapped onto the reinforcing mesh fabric elements which, once inside the locking portion cannot escape. Triangular shaped mold spacer portions 30 and 32 are provided that extend beyond both of the locking portions to space both sides of a double-fabric assembly from corresponding mold walls.

Figure 1D:
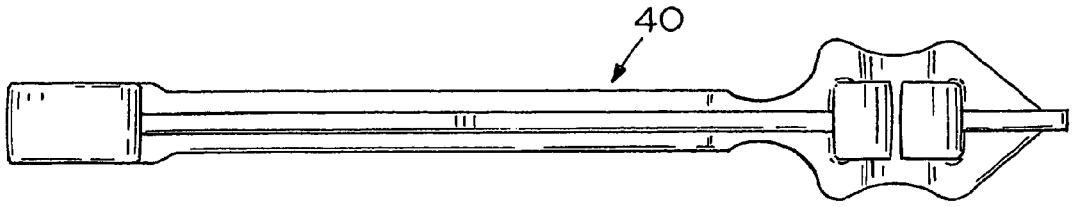
FIGS. 1D and 1E are top and side views of an alternate embodiment of the spacer having a single end spacer for use in, for example, a double cage system.
Figure 1E:
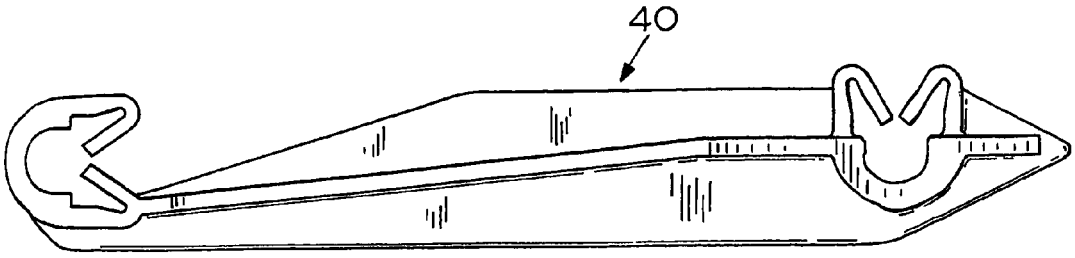

FIGS. 1D and 1E, show at 40, an embodiment similar to that shown in FIGS. 1A-1C with the exception that only a single mold spacer portion 32 is provided. Such a spacer may be useful in assembling a reinforcing structure in an application such as a sanitary sewer, or the like, in which leakage through the structure in the vicinity of the spacers cannot be tolerated.

Figure 2A:
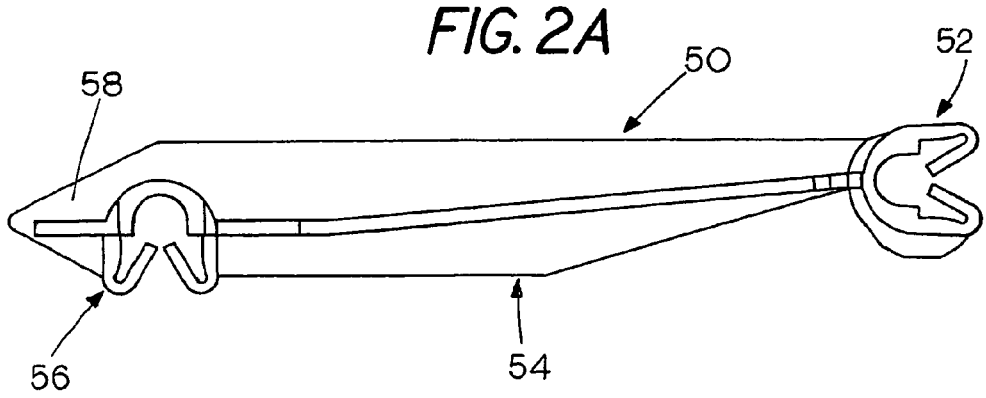
FIGS. 2A-2C depict side views of alternate embodiments of the spacer element of the invention.
Figure 2B:
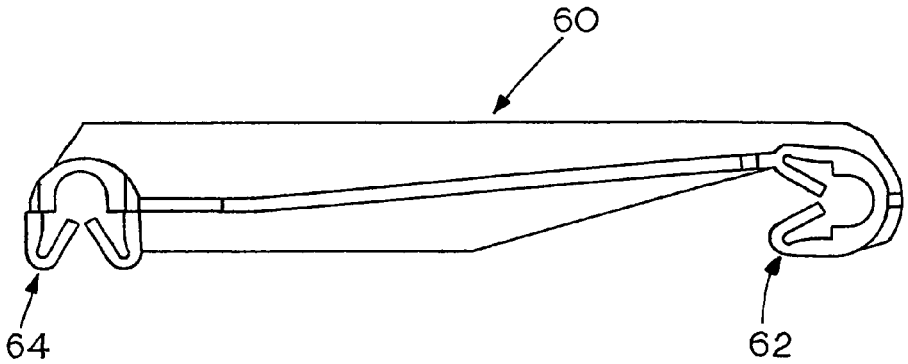
Figure 2C:
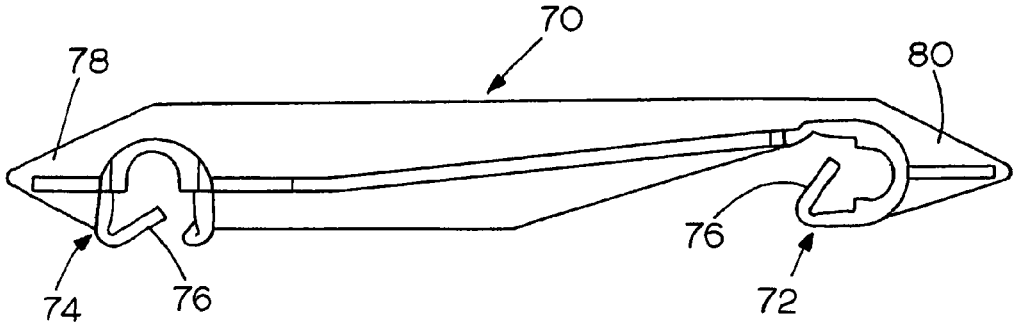

Alternate exemplary embodiments are illustrated in FIGS. 2A-2C. In FIG. 2A, there is shown an alternate embodiment 50 in which a first locking portion 52 has an entrance facing away from and generally parallel to the central portion 54 such that a spacer 50 can simply be inserted through an opening in the mesh of a first fabric and the locking portion 52 snapped directly onto an element of the spaced second fabric and then the second locking portion shown at 56 simply snapped onto a corresponding element of the first fabric without the need to maneuver or manipulate the spacer device further. That embodiment is shown with one mold spacer extension 58, but it will be appreciated that an additional mold spacer may be provided to extend from the locking portion 52, if desired.

FIG. 2B illustrates yet another embodiment 60 in which the first and second spaced locking portions 62 and 64, respectively, are arranged generally as in the embodiments of FIGS. 1A-1E, however, this embodiment is produced without mold spacer extensions. FIG. 2C shows yet another embodiment 70 in which first and second locking portions 72 and 74 are provided with a single inward directed capture member or retention member as at 76 for retaining a captured reinforcement fabric element. Mold spacers are shown at 78 and 80.

It will be appreciated that many other variations with respect to other embodiments are possible within the scope of the inventive concept. For example, any of the shown embodiments can be made with none, one or two mold spacer portions extending beyond the locking portions. In addition, any of the locking portions can be made using opposed pairs of capture or retention members or single capture or retention members. It will also be appreciated that double side-by-side locking portions can also be used having one or two retention members.

Figure 3A:
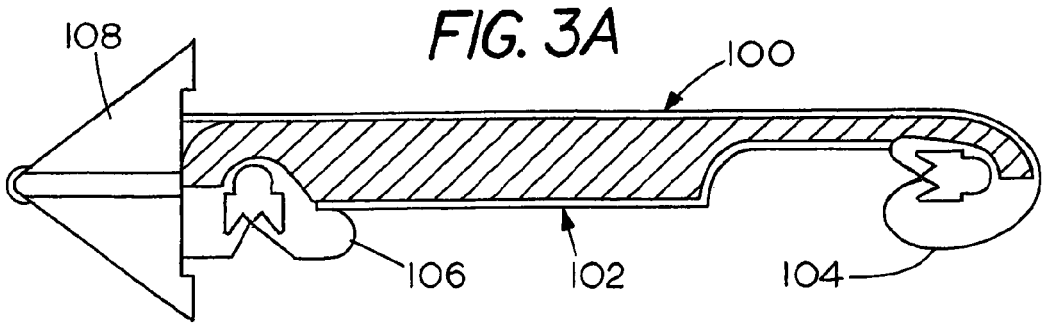
FIGS. 3A-3B depict yet another embodiment of the inventive concept.
Figure 3B:
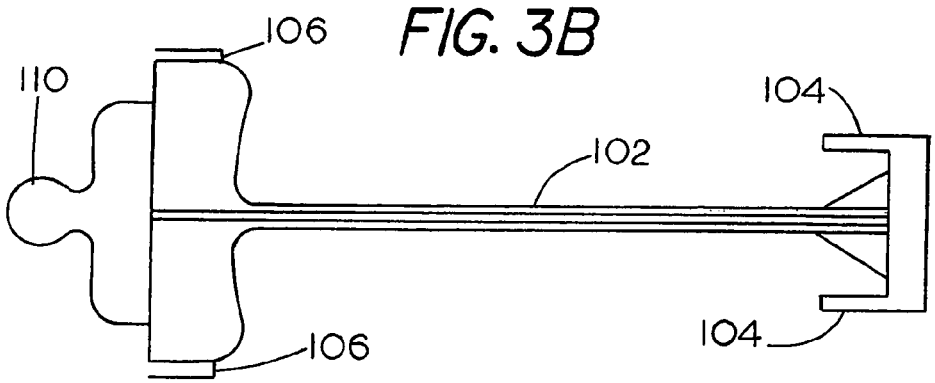

Additional alternate embodiments are shown in FIGS. 3A-3B and 4A-4B. The embodiments of FIGS. 3A-3B illustrate a concept in which a spacer element 100 includes a central portion 102 which may be fabricated of a stamped metal shape which reinforces and connects spaced first and second locking portions 104 and 106, respectively. A mold spacer extension is shown at 108. In this embodiment, the first and second spaced locking portions 104 and 106 both include a pair of spaced locking portions as shown in FIG. 3B. The two spaced locking portions provide two points of contact and capture with each of the spaced fabric elements to which the spacer is attached. This adds strength and stability to the system where necessary. The mold spacer element or mold spacer portion 108 also is configured to provide a finger hold at 110 for use in installing the spacer device 100.

Figure 4A:
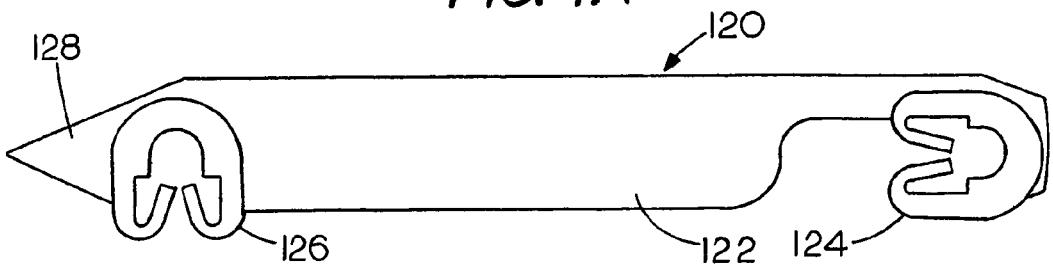
FIGS. 4A-4B represent still another embodiment of the spacer element of the invention.
Figure 4B:
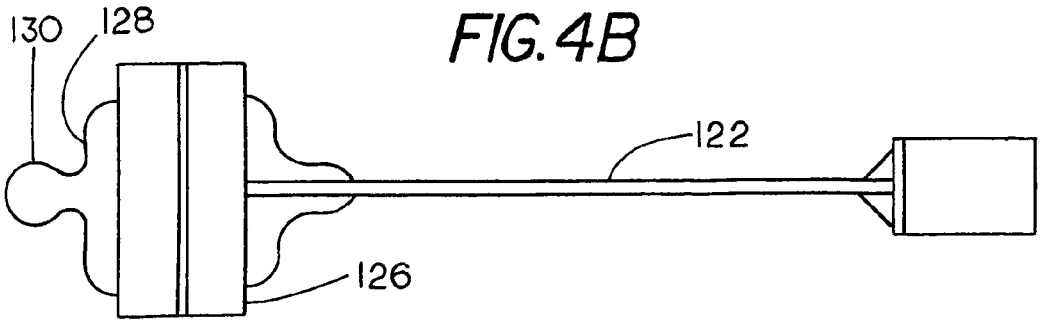

Yet another embodiment 120 is shown in FIGS. 4A and 4B in which a metal central portion 122 connects first and second spaced locking portions 124 and 126. In this embodiment, the locking portion 126 is shown as a relatively wide portion compared to the locking portion 124, however, both locking portions, together with a mold spacer extension portion 128, are molded integrally with the metallic central connecting portion 122. A finger-manipulating hold is shown at 130.

The mold spacer portions in the various embodiments are shown as triangular or pyramidal in shape, however, they may be of any convenient shape and also, they may be of any desired length. This is also true of the central portions of the various embodiments inasmuch as the device may be made of any convenient length necessary to connect fabric configurations spaced at any convenient distance as they can be used to create a variety of reinforcement structures.

It will also be appreciated that it is an important aspect of the invention that all of the embodiments of the invention are constructed such that only a straight line or push-pull-type action is required to connect the first locking portion over a more remote fabric element. This can easily be accomplished by simply using finger grips provided on the opposite ends of the devices or by gripping the opposite end. Thus, the first locking portion can be easily used to capture the element of interest in a far fabric and the second or near locking portion snapped onto a corresponding element where leverage to do so is available at the near fabric.

The embodiments of FIGS. 1A-1D and 2A-2C are generally designed to be fabricated of molded plastic materials, with or without internal reinforcing. It will be appreciated, however, that other materials such as reinforced fiberglass can be used as well. The embodiments of FIGS. 3A-3B and 4A-4B combine metal and plastic materials to arrive at strong, easily assembled devices.

The spacers of the present invention are designed to join prefabricated cages or other configurations of meshed metal reinforcement structures which may be square, rectangular, round or any other shape so long as a pair of parallel structures are to be joined at a plurality of elements. The spacers of the invention can be applied to connect horizontal or vertical mesh fabric elements with equal ease. The reinforcing fabrics may be made of any stable reinforcing material, such as wire rebar or even fiberglass reinforced rod. Of course, the locking portions may be made of any size to best accommodate a particular size rebar or other mesh rod used in the reinforcing fabric.

Figure 5:
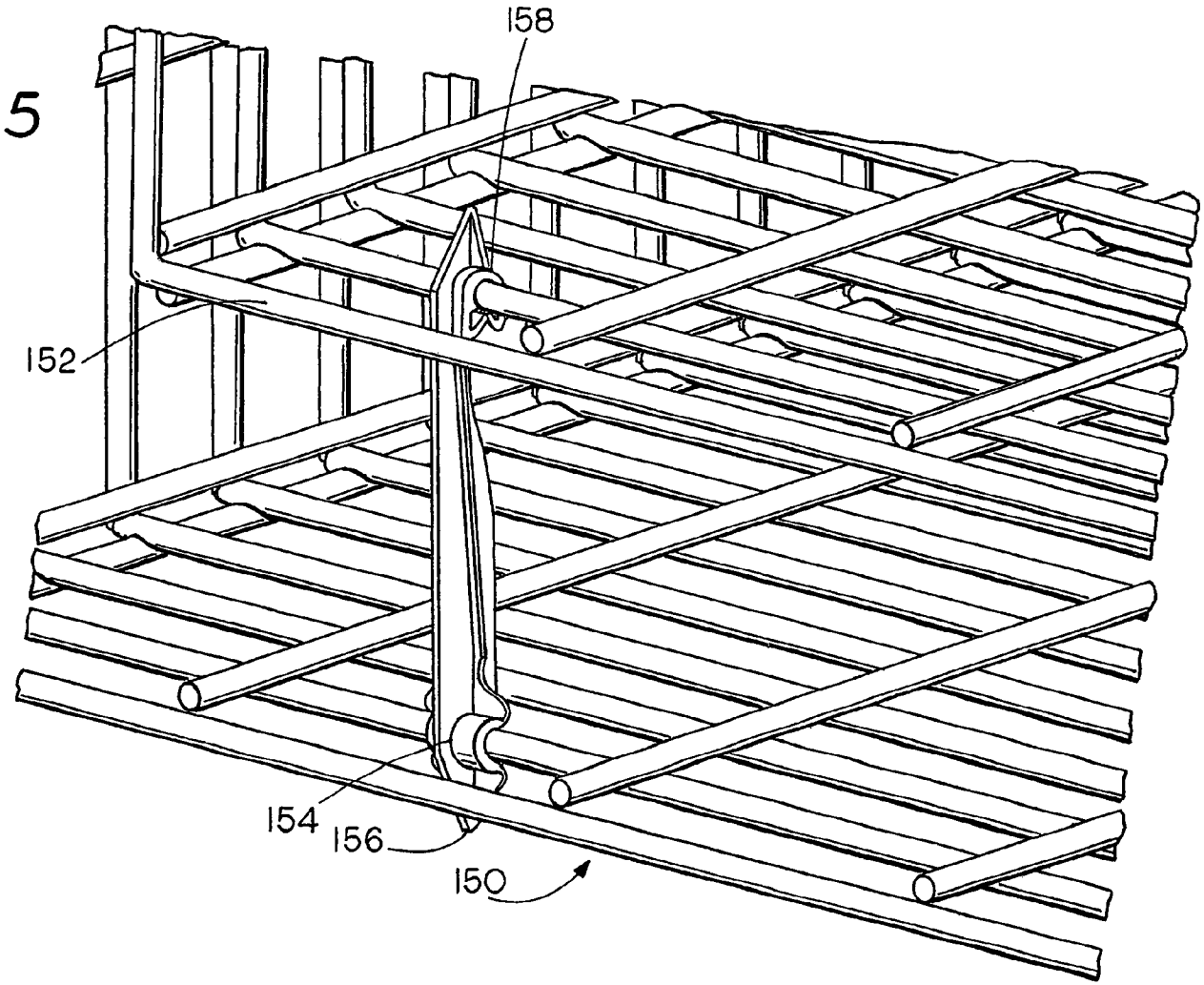
FIG. 5 depicts a box pyramid lock showing a spacer in accordance with the invention in place.

FIG. 5 shows a spacer in accordance with the invention in place, connecting two mesh structures 150 and 152, reinforcing box pyramid structure. The spacer shown in FIG. 5 is provided with mold spacer portions 156 and 158 on both ends to space the network between two walls of a mold. It will be appreciated that while the invention has been described as connecting two mesh structures, three or more consecutive structures can be spaced and connected in the same manner, if desired.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A spacer device for spacing and positioning a pair of rebar or spaced mesh fabric shapes for use in reinforcing concrete structures comprising:

(a) a pair of spaced locking portions, including first and second locking portions, each having a trough for receiving a fabric element and a trapping and retaining component for capturing and retaining said fabric element;

(b) a generally straight central portion connecting said pair of spaced locking portions said locking portions being located toward the ends thereof, wherein said central portion includes a reinforcing rib shape;

(c) wherein said first locking portion has an entrance directed toward and accessible generally in a direction extending back along said central portion toward said second locking portion and said second locking portion has an entrance directed toward and accessible generally at an angle directed away from both said central portion and the entrance of said first locking portion; and (d) wherein said device is configured to include a relative angle between said first and said second locking portions that enables a user to install said device by inserting said spacer through an opening in the mesh of a first fabric, hooking said first locking portion over an element of a second fabric beyond said first fabric and retract said spacer to lock said first locking portion onto said element of said second fabric spaced from said first fabric and thereafter simply pivoting said spacer to engage and lock said second locking portion onto a corresponding element of said first fabric.

2. A spacer as in claim 1 further comprising one or more mold spacer portions extending beyond one or both of said locking portions to space one or both sides of a double-fabric assembly from a mold wall.

3. A spacer as in claim 2 comprising a pair of mold spacers extending both ends of said spacer.

4. A spacer as in claim 1 wherein said central portion comprises reinforcing metal.

5. A spacer as in claim 1 wherein each of said first and second locking portions includes at least one integral inward directed capture member extending generally at an angle from the entrance thereof that is deflected resiliently by an object entering said locking portion such that said object is captured and locked in place once beyond said at least one inward-directed member.

6. A spacer as in claim 5 wherein at least one of said locking portions includes a pair of opposed inward-directed capture members for capturing and locking an object.

7. A spacer as in claim 6 wherein both of said locking portions include a pair of opposed inward-directed capture members for capturing and locking an object.

8. A spacer as in claim 5 wherein at least one of said locking portions comprises spaced integral inward-directed capture members.

9. A spacer as in claim 5 wherein at least one of said locking portions comprises spaced pairs of opposed inward-directed capture members.

10. A spacer as in claim 1 including an integral finger-grip aspect for ease of handing and installation.

11. A spacer as in claim 1 wherein said spacer comprises a plastic material.

12. A spacer as in claim 11 wherein said spacer comprises a molded plastic material.

13. A spacer as in claim 1 further comprises a metal reinforcing member along the length thereof.

14. A spacer as in claim 1 wherein said reinforcing rib extends through said locking portions.

15. A spacer as in claim 14 wherein said rib is metal.

16. A spacer as in claim 1 wherein said mesh fabric shapes comprise a material selected from steel wire, steel rebar and fiberglass.

17. A spacer as in claim 1 wherein said second locking portion is generally at a right angle with said first locking portion.

18. A spacer as in claim 1 wherein said spaced locking portions are adapted to receive cylindrical objects.

19. A spacer device for spacing and positioning a pair of rebar or spaced mesh fabric shapes for use in reinforcing concrete structures comprising:

(a) a pair of spaced locking portions, including first and second locking portions, each having a trough for receiving a fabric element and a trapping and retaining component for capturing and retaining said fabric element;

(b) a generally straight central portion connecting said pair of spaced locking portions said locking portions being located toward the ends thereof;

(c) wherein said first locking portion has an entrance at one end of said central portion facing away from and having an entrance generally parallel to said central portion and said second locking portion has an entrance directed toward and accessible generally at an angle directed away from both said central portion and the entrance of said first locking portion; and (d) wherein said device is configured to include a relative angle between said first and said second locking portions that enables a user to install the device by inserting said device through an opening in the mesh of a first fabric, and locking said first locking portion on to an element of a second fabric beyond said first fabric by simply pushing said spacer forward parallel to said central portion, and completing installation by simply snapping said second locking portion directly onto a corresponding element of said first fabric by pivoting the device about said element of said second fabric.

20. A spacer as in claim 19 wherein said second locking portion has an entrance generally at a right angle with said central portion.

21. A spacer as in claim 19 wherein said mesh fabric shapes comprise a material selected from steel wire, steel rebar and fiberglass.

22. A spacer as in claim 19 further comprising one or more mold spacer portions extending beyond one or both of said locking portions to space one or both sides of a double-fabric assembly from a mold wall.

23. A spacer as in claim 22 comprising a pair of mold spacers extending both ends of said spacer.

24. A spacer as in claim 19 wherein said central portion includes a reinforcing rib.

25. A spacer as in claim 24 wherein said reinforcing rib extends through said clip components.

26. A spacer as in claim 25 wherein said rib is metal.

27. A spacer as in claim 19 wherein said central portion comprises reinforcing metal.

28. A spacer as in claim 19 wherein each of said first and second locking portions includes at least one integral inward directed capture member extending generally at an angle from the entrance thereof that is deflected resiliently by an object entering said locking portion such that said object is captured and locked in place once beyond said at least one inward-directed member.

29. A spacer as in claim 28 wherein at least one of said locking portions comprises spaced integral inward-directed capture members.

30. A spacer as in claim 28 wherein at least one of said locking portions comprises spaced pairs of opposed inward-directed capture members.

31. A spacer as in claim 19 wherein at least one of said locking portions includes a pair of opposed inward-directed capture members for capturing and locking an object.

32. A spacer as in claim 19 wherein both of said locking portions include a pair of opposed inward-directed members for capturing and locking an object.

33. A spacer as in claim 19 including an integral finger-grip aspect for ease of handing and installation.

34. A spacer as in claim 33 wherein said spacer comprises a molded plastic material.

35. A spacer as in claim 19 wherein said spacer comprises a plastic material.

36. A spacer as in claim 19 further comprises a metal reinforcing member along the length thereof.

37. A spacer as in claim 19 wherein said spaced locking portions are adapted to receive cylindrical objects.

38. A concrete reinforcement structure having first and second reinforcing mesh fabric shapes spaced and secured in relative position by a plurality of spacers, said spacers further comprising:

(a) a pair of spaced locking portions, including first and second locking portions, each having a trough for receiving a cylindrical object and a trapping and retaining component for capturing said cylindrical object;

(b) a generally straight central portion connecting said pair of spaced locking portions; and (c) wherein said spacer is configured such that said first locking portion has an entrance directed generally in a direction parallel to and extending beyond said central portion such that said spacer can be inserted through an opening in the mesh of a first fabric, and snapped on to an element of a second fabric beyond said first fabric by a generally linear pushing action parallel to said central portion to lock said first locking portion onto said element of said second fabric and wherein said second locking portion has an entrance configured such that an angle between said first and said second locking portions enables said spacer simply to be pivoted to engage said second locking portion onto a corresponding element of said first fabric.

39. A concrete reinforcement structure as in claim 38 wherein said spacers further comprise one or more mold spacer portions extending beyond one or both of said locking portions to space one or both sides of a double-fabric assembly from a mold wall.

40. A concrete reinforcement structure as in claim 39 wherein said reinforcement structure is a double-cage structure and wherein said spacers include a mold spacer portion extending beyond one of said locking portions.

41. A concrete reinforcement structure as in claim 38 wherein said structure is a box pyramid and wherein said spacers comprise mold spacer portions extending beyond both of said locking portions.

42. A concrete reinforcement structure as in claim 38 wherein each of said first and second locking portions of said spacers includes at least one integral inward-directing capture member extending generally at an angle from the entrance thereof that is deflected resiliently by a cylindrical object entering said clip component such that said cylindrical object is captured and locked in place one beyond said at least one inward-directed member.

43. A concrete reinforcement structure as in claim 42 wherein both of said locking portions include a pair of opposed inward-directed members for capturing and locking an object.

44. A concrete reinforcement structure as in claim 38 wherein said spacer members comprise a plastic material.

45. A concrete reinforcement structure as in claim 44 wherein said spacers further comprise a reinforcing rib.

46. A concrete reinforcement structure as in claim 45 wherein said rib is metal.

47. A concrete reinforcement structure as in claim 38 wherein the shape thereof is selected from round, flat and rectangular shapes.

* * * * *

UNITED STATES PATENT AND TRADEMARK OFFICE

CERTIFICATE OF CORRECTION

PATENT NO. : 8,322,109 B2
APPLICATION NO. : 12/474849
DATED : December 4, 2012
INVENTOR(S) : Julian P. Trangsrud It is certified that error appears in the above-identified patent and that said Letters Patent is hereby corrected as shown below:

In column 7, line 50, "handing" should be changed to "handling".

Signed and Sealed this
Twelfth Day of March, 2013

Teresa Stanek Rea
*Acting Director of the United States Patent and Trademark Office*